US009951485B2

(12) United States Patent
Tichell Fortea

(10) Patent No.: US 9,951,485 B2
(45) Date of Patent: Apr. 24, 2018

(54) CART FOR BUILDING A BRIDGE BOARD FORWARD PROGRESSIVE

(71) Applicant: RUBRICA INGENIERIA Y ARQUITECTURA,S.L., Grao, Castellon (ES)

(72) Inventor: Enrique Tichell Fortea, Castellon (ES)

(73) Assignee: RUBRICA INGENIERIA Y ARQUITECTURA,S.L., Grao (ES)

( * ) Notice: Subject to any disclaimer, the term of this patent is extended or adjusted under 35 U.S.C. 154(b) by 295 days.

(21) Appl. No.: 14/877,398

(22) Filed: Oct. 7, 2015

(65) Prior Publication Data

US 2016/0115659 A1 Apr. 28, 2016

(30) Foreign Application Priority Data

Oct. 27, 2014 (ES) ..... 201431395 U

(51) Int. Cl.
*E01D 21/10* (2006.01)
*E01D 21/00* (2006.01)

(52) U.S. Cl.
CPC ..... *E01D 21/00* (2013.01); *E01D 21/10* (2013.01)

(58) Field of Classification Search
CPC ..... E01D 21/10; E01D 21/00
USPC ..... 425/63
See application file for complete search history.

(56) References Cited

U.S. PATENT DOCUMENTS

| | | | | | |
|---|---|---|---|---|---|
| 3,571,835 | A * | 3/1971 | Buechler | E01D 21/00 | 14/77.1 |
| 3,579,759 | A * | 5/1971 | Zuccolo | E01D 21/00 | 249/209 |
| 4,103,861 | A * | 8/1978 | Buchler | E01D 21/105 | 14/77.1 |
| 4,315,701 | A | 2/1982 | Ivanov et al. | | |
| 6,193,442 | B1 | 2/2001 | May | | |
| 6,655,875 | B1 | 12/2003 | Pignato | | |
| 2012/0004659 | A1 | 1/2012 | Miller et al. | | |

FOREIGN PATENT DOCUMENTS

| | | | | |
|---|---|---|---|---|
| DE | 1263806 | | 3/1968 | |
| ES | 2398177 | | 3/2013 | |
| FR | 546289 | | 11/1922 | |
| FR | 1502024 | A | 11/1967 | |
| FR | 1522923 | | 4/1968 | |
| FR | 1570648 | | 6/1969 | |
| FR | 2570112 | A1 * | 3/1986 | E01D 21/10 |
| FR | 2691204 | A1 | 11/1993 | |
| GB | 1487138 | A | 9/1977 | |
| NO | 153502 | B | 12/1983 | |
| WO | 2013149771 | | 10/2013 | |

* cited by examiner

*Primary Examiner* — Robert B Davis
(74) *Attorney, Agent, or Firm* — Brown & Michaels, PC

(57) ABSTRACT

Cart for building a bridge board forward progressive which incorporates a system for positioning reinforcement pieces, which have displacement tracks on the upper working surface and runners on which the reinforcement pieces are situated and which are displaced on the displacement tracks, where by means of the system for positioning reinforcement pieces it situates the reinforcement pieces in a position of the upper working surface for a subsequent concreting of a section of the board of the bridge, with the cart being fixed in the position thereof.

5 Claims, 5 Drawing Sheets

CART FOR BUILDING A BRIDGE BOARD FORWARD PROGRESSIVE

BACKGROUND OF THE INVENTION

Field of the Invention

The present invention relates to a device which improves the carts for building bridges forward progressive, aimed at improving the insertion of special pieces, which are embedded in the concrete, a structural part formed from the platform constituting the bridge.

Description of Related Art

In the construction of bridges it is common during the design for the incorporation of special pieces to be planned during the construction of the bridge which reinforce the structure of the bridge.

The concreting of a bridge is carried out in sections. Furthermore, in bridges of large dimensions, a cart is used which advances along the length of the bridge, being positioned in successive positions in order to carry out successive placements of concrete via the cited cart.

The cart serves to support the formworks which configure the form of the bridge and on which the concrete is poured in successive placements.

The installation of these special pieces during the implementation of the construction works is carried out in the following manner:

- with the cart in a concreting position, the special pieces are positioned on the cart by means of a crane,
- the cart is made to advance to the following concreting position but with the cart carrying said special pieces,
- a new section is concreted with the cart positioned in the new position.

These special pieces, given the reinforcing nature thereof, are pieces with very high weight (10, 15, 20 tons) such that the positioning operation of said special pieces on the cart and the subsequent advance of the cart for the concreting of a section of bridge with the piece on the cart is a very delicate and dangerous operation, firstly because the mere fact of a crane leaving the special pieces with their high weight on the cart is an operation which can cause significant damage to the advance system of the cart and secondly, because the cart should be moved, without being secured to the structure, forwards to the following position with the special pieces on the cited cart.

SUMMARY OF THE INVENTION

The invention, which is described, discloses a cart for building a bridge board forward progressive which comprises two central longitudinal beams, two lateral longitudinal beams, one principal transversal beam joining the two central longitudinal beams and the two lateral longitudinal beams, a plurality of transversal support beams along the central longitudinal beams and the lateral longitudinal beams and one upper working surface situated on the central longitudinal beams, the lateral longitudinal beams, the principal transversal beam and the plurality of transversal support beams.

The cart, object of the invention, comprises a system for positioning reinforcement pieces, which comprises displacement tracks on the upper working surface and runners on those where the reinforcement pieces are situated and which are displaced on the displacement tracks.

In the cart, object of the invention, the reinforcement pieces are situated in a position of the upper working surface by means of the system for positioning reinforcement pieces for subsequent concreting of a section of the board of the bridge, with the cart being fixed in the position thereof.

The cart for building a bridge board forward progressive comprises two types of runners, runners for lateral reinforcement pieces and runners for central reinforcement pieces.

The runners for lateral reinforcement pieces comprise a first base joined to a piece in an inverted L-shape by means of a hydraulic cylinder and the runners for central reinforcement pieces comprise a second base on which is situated the central reinforcement piece and a lower clamp and an upper clamp joined to a second base and fixed to the central reinforcement piece.

The piece in an inverted L-shape of the runners for the lateral reinforcement pieces is fixed to the lateral reinforcement piece by means of a threaded bar.

The lower clamp and the upper clamp of the runners for central reinforcement pieces comprise two opposing pieces joined by a threaded bar with the central reinforcement piece between the opposing pieces.

Each opposing piece of the upper clamp is fixed to one end of the second base by means of a beam with the capacity to turn around the fixing to the second base.

BRIEF DESCRIPTION OF THE DRAWING

In order to complement the description and with the aim of aiding a better understanding of the characteristics of the invention, a set of drawings accompany this specification as an integral part thereof, in which, in an illustrative and non-limiting manner, the following is represented.

PREFERRED EMBODIMENT OF THE INVENTION

Figure 1:
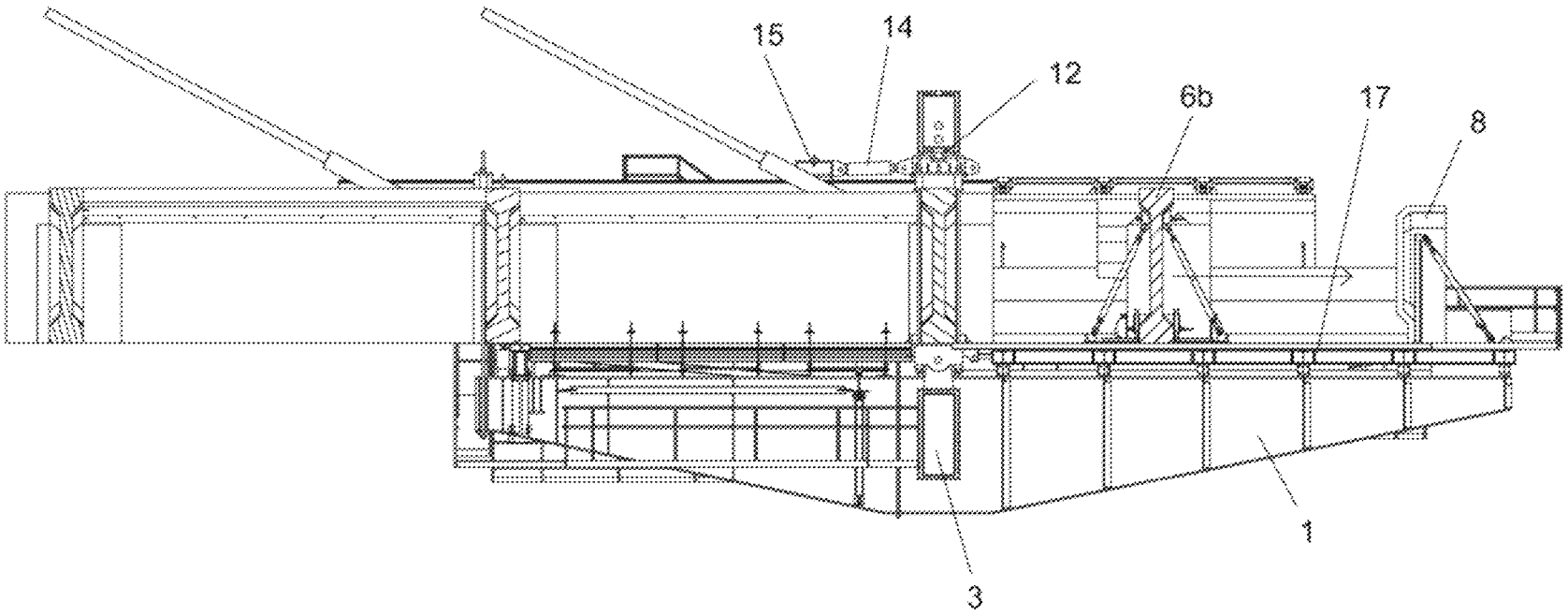
FIG. 1 shows a lateral view of the cart in a concreting position.
Figure 2:
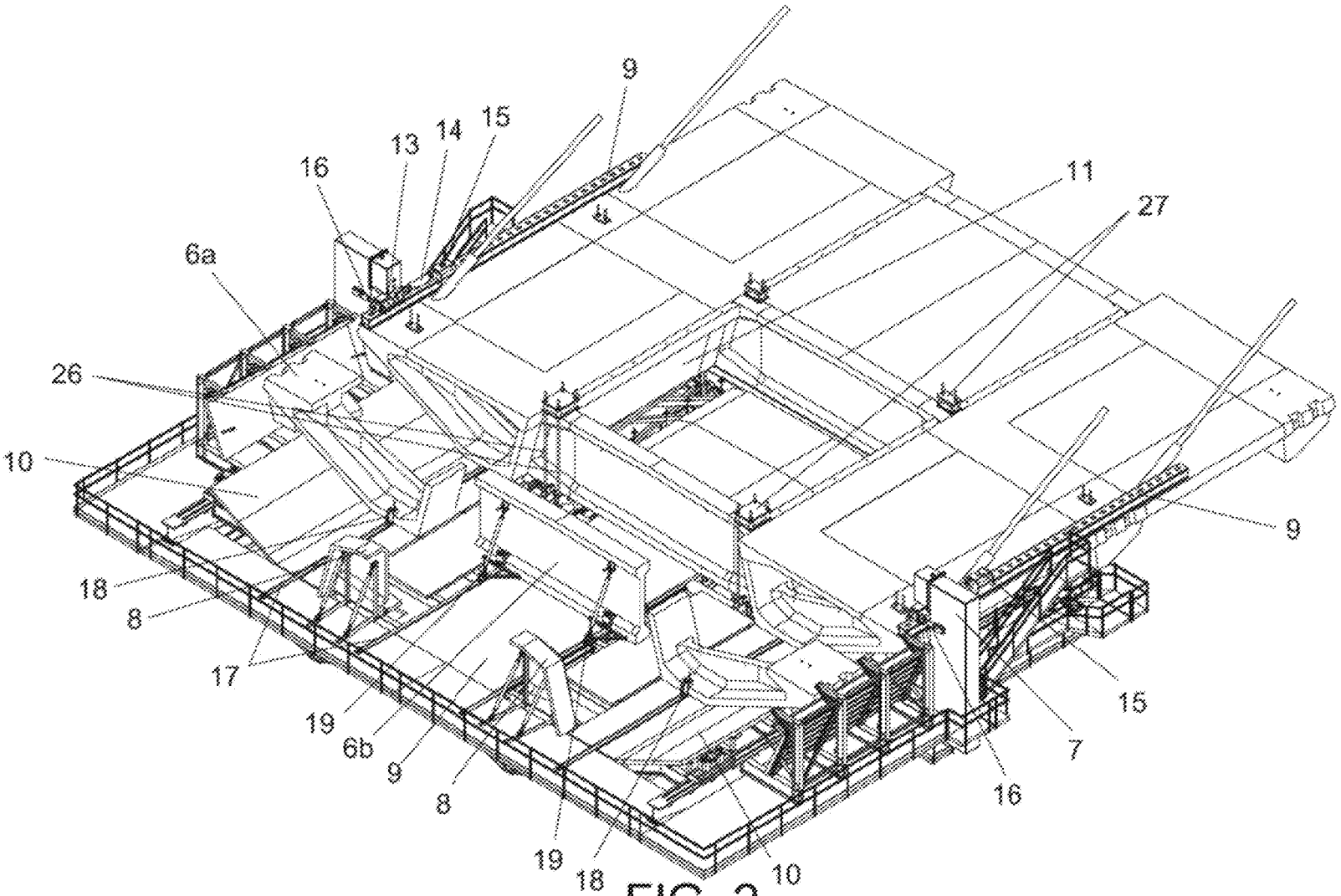
FIG. 2 represents a perspective of the assembly of FIG. 1.
Figure 3:
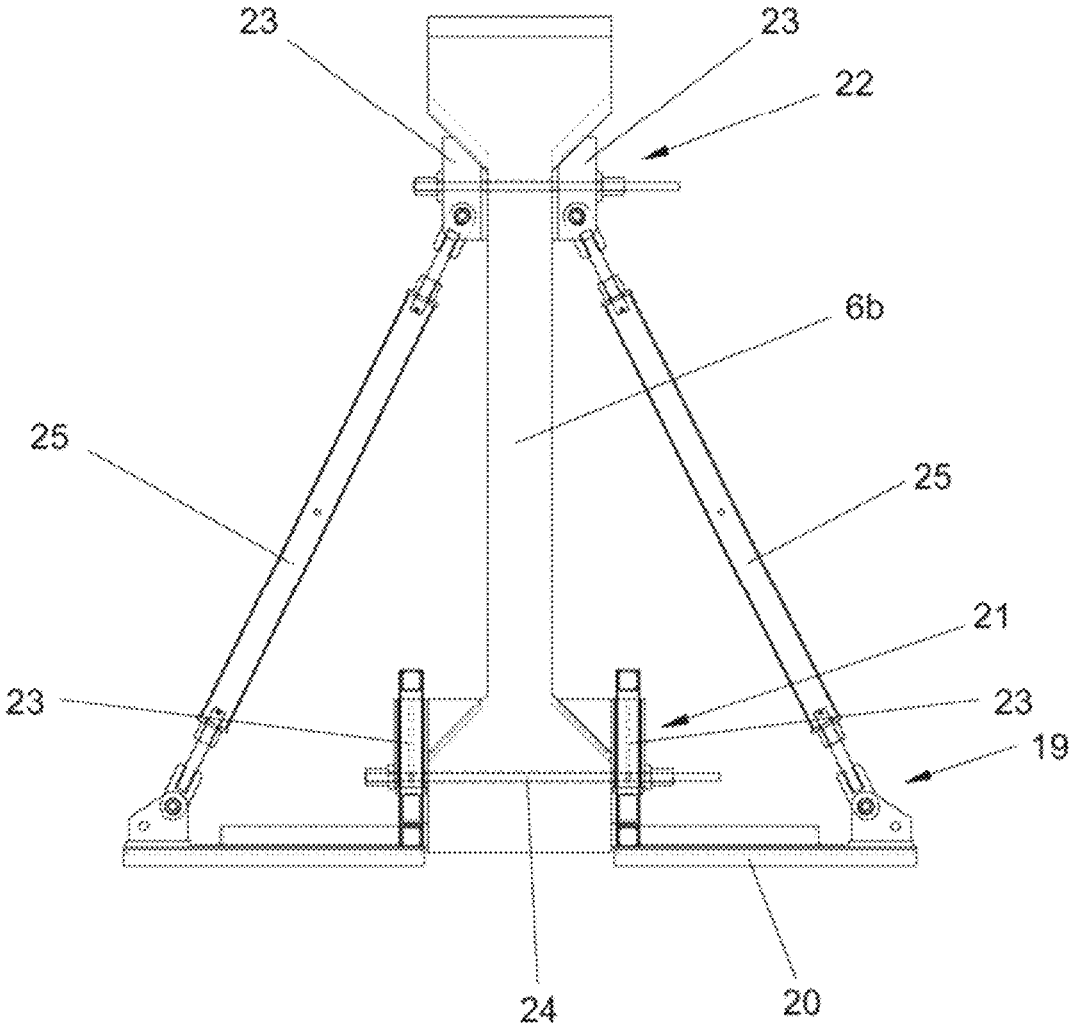
FIG. 3 is a detail of a manner of fixing the special pieces for the advance thereof.
Figure 4:
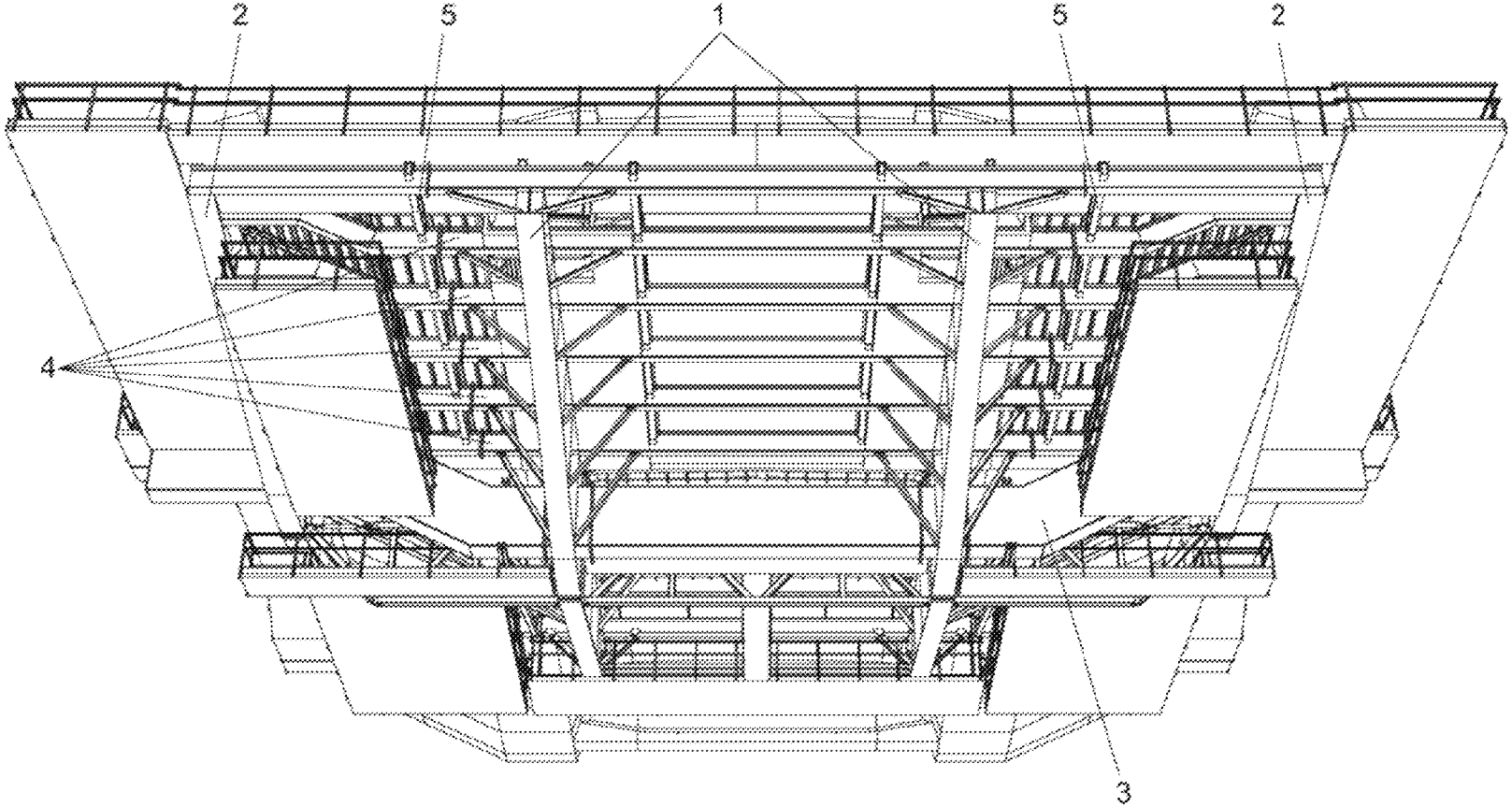
FIG. 4 shows a perspective view of the cart from the lower area.
Figure 5:
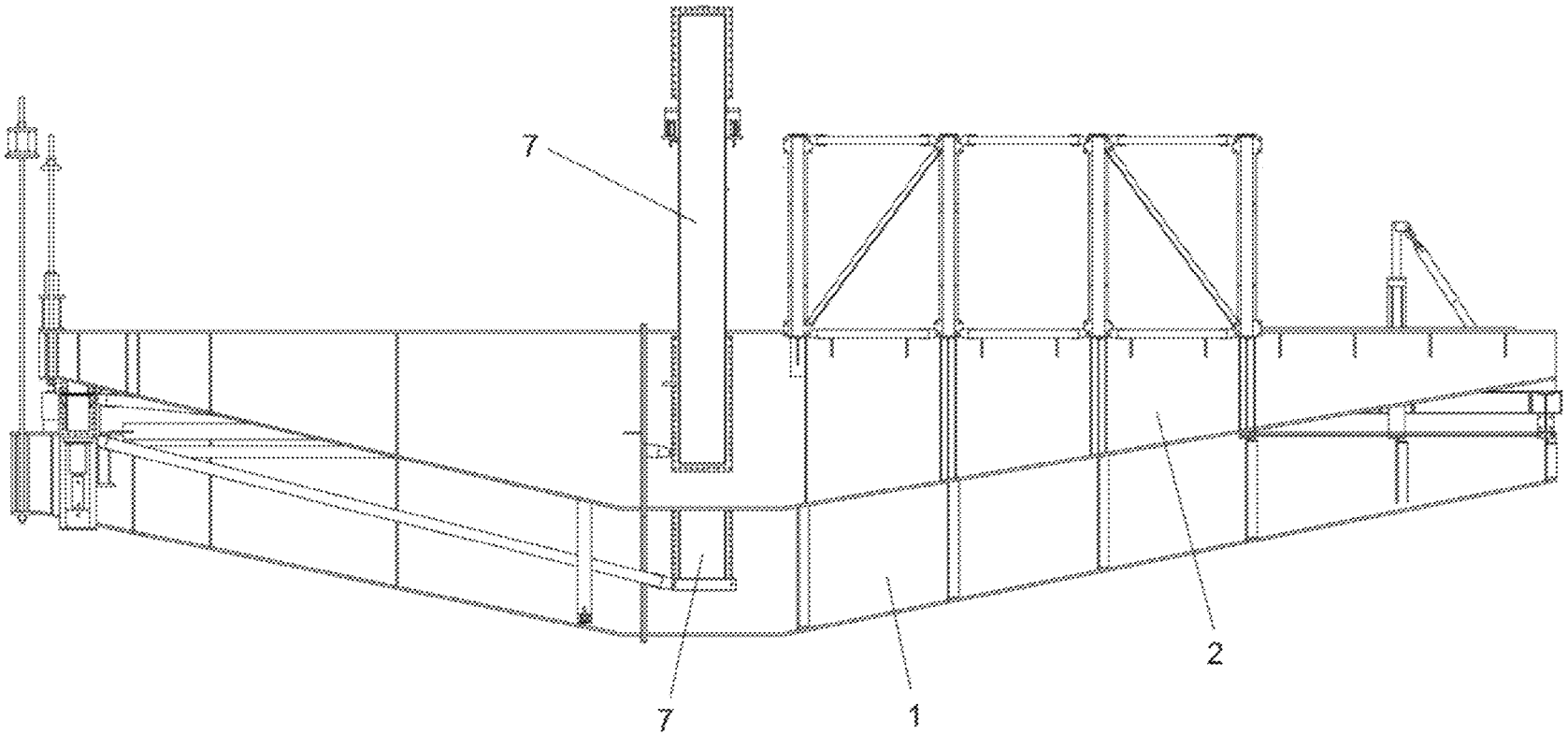
FIG. 5 shows a lateral view of the structure of beams which form the cart.

As has already been indicated and as can be observed in the figures, the object of the invention is a cart for building a bridge forward progressive, which facilitates the positioning of reinforcement pieces (6*a*, 6*b*) in a secure and constant manner.

The cart, object of the invention, comprises two central longitudinal beams (1) and two lateral longitudinal beams (2), joined to each other by a principal transversal beam (3) which serve to support all the other components which form the cart, object of the invention. In addition to the principal transversal beam (3), the cart, object of the invention comprises a series of transversal support beams (4) situated along the central longitudinal beams (1) and the lateral longitudinal beams (2) which help to provide support to the other components which form the cart, object of the invention. The cart, object of the invention, also comprises a plurality of longitudinal stiffening beams (5) which join the transversal support beams (4) to each other, such that the longitudinal stiffening beams (5) provide rigidity to the cart, object of the invention.

A bridge board built with the cart, object of the invention, comprises a transversal section which is divided into two laterals and one central area, where the two laterals have a V section and the central area is a rectangular section. The transversal section of the bridge comprises internal walls between the laterals with the V section and the central area, likewise at the exterior ends of the laterals, the transversal section of the bridge comprises exterior walls.

In order to build this type of bridge, the reinforcement pieces (6*a*, 6*b*) are used which in the case of lateral reinforcement pieces (6*a*) have the section of the laterals of the bridge, and in the case of the central reinforcement pieces (6*b*) have a rectangular section. When the two reinforcement pieces (6*a*, 6*b*) are in the definitive position between them, there is a free space, which requires concreting to fill it.

The cart, object of the invention, comprises an upper working surface, where the elements are located which the cited cart uses for the positioning of the reinforcement pieces (6*a*, 6*b*) in secure conditions and the formworks requires for carrying out the concreting of the sections of the bridge in phases.

The principal transversal beam (3) comprises, at the lateral ends, an L-shaped structure (7) which is shown through the upper working area. In the L-shaped structure (7), securing and advancing means of an advance track (9) by way of which the cart, object of the invention, advances, being supported on an already built bridge section.

The securing and advancing means comprise:

an adjustment jack (12) incorporated in the L-shaped structure (7) which incorporates, at the end thereof, a raceway foot (13) on the advance tracks (9);

first hydraulic cylinders (14) which join the raceway foot (13) to a foot fixed (15) on the advance track (9), but the position of which on the advance track can be changed, such that said first hydraulic cylinders (14) are responsible for providing the advance movement to the advance tracks (9);

second hydraulic cylinders (16) which fix the raceway foot (13) to the L-shaped structure (7) allowing a rotational movement of the raceway foot (13) around the joining point to the L-shaped structure (7).

The formworks which comprise the cart, object of the invention, are:

- corner formwork (8) to contain the fresh concrete in the contact areas between the lateral reinforcement pieces (6*a*) and the central reinforcement pieces (6*b*);
- ground formwork (9) to contain the fresh concrete in the ground areas of the transversal section of the bridge;
- external lateral formworks (10) to contain the fresh concrete of the exterior walls of the transversal section of the bridge;
- internal lateral formworks (11) to contain the fresh concrete of the internal walls of the transversal section of the bridge.

The cart, object of the invention, comprises a plurality of fixing bars (26) which join the central longitudinal beams (1) and the lateral longitudinal beams (2) to a section of an already constructed section of bridge, using support plates (27) for the support on the already constructed section of bridge.

The cart, object of the invention, comprises a system for positioning the reinforcement pieces (6*a*, 6*b*) which avoids conflicting works being carried out in the positioning of the cited reinforcement pieces (6*a*, 6*b*) and also avoids an advance of the cart with the reinforcement pieces (6*a*, 6*b*) in the use position.

The system for positioning the reinforcement pieces (6*a*, 6*b*) of the cart, object of the invention, comprises a series of elements on the upper working surface which fix the reinforcement pieces (6*a*, 6*b*) on displacement tracks (17) and position them in the definitive location thereof without the need to displace the cart as occurs with the carts used hitherto for this type of construction.

Both the lateral reinforcement pieces (6*a*) and the central reinforcement pieces (6*b*) are positioned on runners which are displaced on the displacement tracks (17).

Two types of runners are distinguished, the runner for lateral reinforcement pieces (18) and the runners for central reinforcement pieces (19).

The runners for lateral reinforcement pieces (18) comprise a first base to which is joined an inverted L-shaped piece which holds the lateral reinforcement piece (6*a*) by the base of the lateral reinforcement piece (6*a*). The inverted L-shaped piece is joined to the lateral reinforcement piece (6*a*) by means of a threaded bar which is fixed to each lateral reinforcement piece (6*a*) by the lower part of the same. The inverted L-shaped piece is also joined to the first base by means of a hydraulic cylinder, which allows an ascending or descending movement of the inverted L-shaped piece with respect to the first base.

The runners for the central reinforcement pieces (19) comprise a second base (20) on which is situated the central reinforcement piece (6*b*) and a lower clamp (21) ad an upper clamp (22) joined to this second base (20).

Both the lower clamp (21) and the upper clamp (22) of the runners for the central reinforcement pieces (19) comprise two opposing pieces (23) joined by a threaded bar (24), Each opposing piece (23) of the upper clamp (22) is joined to one end of the second base (20) by means of a beam (25) which can turn around the joining to the second base (20) separating or approximating the piece opposed (23) to the central reinforcement piece (6*b*).

The invention should not be viewed as limited to the particular embodiment described in this document. Persons skilled in the art can develop other embodiments in view of the description given here. Consequently the scope of the invention is defined by the following claims.

TABLE OF REFERENCE NUMBERS

The different reference numerals which are reflected in the figures correspond to the following elements:

1.—central longitudinal beam
2.—lateral longitudinal beam
3.—principal transversal beam
4.—transversal support beam
5.—longitudinal stiffening beam
6*a*.—lateral reinforcement piece
6*b*.—central reinforcement piece
7.—L-shaped structure
8.—corner formwork
9.—ground formwork
10.—external lateral formwork
11.—internal lateral formwork
12.—adjustment jack
13.—raceway foot
14.—first hydraulic cylinder
15.—foot fixed to the advance track
16.—second hydraulic cylinder
17.—displacement track
18.—runner for lateral reinforcement piece
19.—runner for central reinforcement piece
20.—second base
21.—lower clamp
22.—upper clamp
23.—opposing piece
24.—threaded bar
25.—beam

26.—plurality of fixing bars

27.—support plate.

What is claimed is:

1. A cart for building a bridge board forward progressive comprising:

two central longitudinal beams (1);

two lateral longitudinal beams (2);

one principal transversal beam (3) joining the two central longitudinal beams (1) and the two lateral longitudinal beams (2);

a plurality of transversal support beams (4) along the central longitudinal beams (1) and the lateral longitudinal beams (2); and one upper working surface situated on the central longitudinal beams (1), the lateral longitudinal beams (2), the principal transversal beam (3) and the plurality of transversal support beams (4)

characterized in that the cart comprises a system for positioning reinforcement pieces (6*a*, 6*b*) which comprises:

displacement tracks (17) on the upper working surface; and runners on which the reinforcement pieces (6*a*, 6*b*) are situated and which are displaced on the displacement tracks (17), wherein by means of the system for positioning reinforcement pieces (6*a*, 6*b*) it situates the reinforcement pieces (6*a*, 6*b*) in a position of the upper working surface for a subsequent concreting of a section of the board of the bridge, with the cart being fixed in the position thereof.

2. The cart for building a bridge board forward progressive according to claim 1, characterized in that it comprises two types of runners:

runners for lateral reinforcement pieces (18); and runners for central reinforcement pieces (19)

wherein the runners for lateral reinforcement pieces (18) comprise a first base joined to an inverted L-shaped piece by means of a hydraulic cylinder and the runners for central reinforcement pieces (19) comprise a second base (20) on which is situated the central reinforcement piece (6*b*) and a lower clamp (21) and an upper clamp (21) joined to a second base (20) and fixed to the central reinforcement piece (6*b*).

3. The cart for building a bridge board forward progressive according to claim 2, characterized in that the inverted L-shaped piece is fixed to the lateral reinforcement piece (6*a*) by means of a threaded bar.

4. The cart for building a bridge board forward progressive according to claim 2, characterized in that the lower clamp (21) and the upper clamp (22) of the runners for central reinforcement pieces (19) comprise two opposing pieces (23) joined by a threaded bar (24) with the central reinforcement piece (6*b*) between the opposing pieces.

5. The cart for building a bridge board forward progressive according to claim 4, characterized in that each opposing piece (23) of the upper clamp (22) is fixed to one end of the second base (20) by means of a beam (25) with the capacity to turn around the fixing to the second base (20).

* * * * *